United States Patent [19]

Fastner et al.

[11] Patent Number: 4,493,452

[45] Date of Patent: Jan. 15, 1985

[54] METHOD OF PRODUCING A PLATE OF STEEL

[75] Inventors: Thorwald Fastner; Max Mayrhofer; Walter Taschner, all of Linz, Austria

[73] Assignee: Voest-Alpine Aktiengesellschaft, Linz, Austria

[21] Appl. No.: 324,837

[22] Filed: Nov. 25, 1981

[30] Foreign Application Priority Data

Dec. 2, 1980 [AT] Austria ..... 5879/80

[51] Int. Cl.[3] ..... B23K 20/04

[52] U.S. Cl. ..... 228/158; 228/176; 228/190; 228/212

[58] Field of Search ..... 228/158, 176, 186, 205, 228/212, 178, 190

[56] References Cited

U.S. PATENT DOCUMENTS

| | | | |
|---|---|---|---|
| 70,212 | 10/1867 | Hindermeyer | 228/190 |
| 158,578 | 1/1875 | Durfee | 228/190 |
| 2,457,861 | 1/1949 | Brassert | 228/158 |
| 2,753,623 | 7/1956 | Boessenkool et al. | 228/205 |
| 4,113,166 | 9/1978 | Olsson | 228/176 X |
| 4,141,482 | 2/1979 | Reynolds | 228/158 |

FOREIGN PATENT DOCUMENTS 4063 9/1979 European Pat. Off. .

*Primary Examiner*—Kenneth J. Ramsey

*Attorney, Agent, or Firm*—Brumbaugh, Graves, Donohue & Raymond

[57] ABSTRACT

In a method of producing heavy plate of steel, a prematerial is hot-rolled in several passes. As the prematerial at least two slabs of the same steel quality are superposed so as to form a pack and are welded by roll-bonding and reduced in thickness.

9 Claims, 20 Drawing Figures

METHOD OF PRODUCING A PLATE OF STEEL

BACKGROUND OF THE INVENTION

The invention relates to a method of producing a plate of steel, in particular one having a thickness of more than 50 mm, by hot-rolling a prematerial in several passes.

In steel construction engineering, in particular for the construction of nuclear power plants, plates of large thicknesses, such as, e.g., of up to 300 mm and more, are required to an increasing extent. The production of such thick plates hitherto has involved great difficulties. It is known for the production of plates, to start from cast ingots of suitable sizes. In order to achieve perfect qualities of the ready plates, a minimum degree of deformation has to be observed when processing them; this minimum degree of deformation is determined in accordance with the quality demands. As a rule, it is more than five; the ingot size depends on the minimum degree of deformation; therefore, with thick plates, ingot weights of between 15 and 60 t are reached.

Ingots of this size cast in a conventional manner are known to be very inhomogenous; the foot section tends to being enriched by inclusions, the head section is segregated and full of pipes reaching as far as to the middle of the ingot. These properties of large ingots, as a result, often cause impermissible failures to be detected in the ready plate by ultrasonic testing, calling for a devaluation or even scrapping of the plates. Also are the mechanical-technological properties of these plates from large ingots, in particular the mechanical-technological properties in the thickness direction, insufficient.

In order to avoid these difficulties, it is known to produce ingots according to special methods, which are, however, very complex and also very expensive due to the high energy consumption involved. Such special methods are the electroslag remelting method (ESR-method) or the Böhler electroslag topping method (B.E.S.T. method).

SUMMARY OF THE INVENTION

The invention aims at avoiding the disadvantages and difficulties described, and has as its object to provide a method of the initially defined kind by which heavy plates, in particular plates of large thicknesses, may be produced with relatively low costs and high, perfect qualities.

This object is achieved according to the invention in that as prematerial at least two slabs of the same steel quality are superposed so as to form a pack and are welded by roll-bonding and reduced in thickness.

Preferably, the slabs are ground on the surfaces that contact each other, the slabs suitably being leveled by pre-deformation.

For particularly high quality demands, slabs are used that are derived from the same steel melt.

According to a variant of the method of the invention to be applied for plates of maximum thicknesses, at least two packs are initially formed of at least two slabs each, wherein, after welding the slab packs into an ingot suitable for rolling, these rolling ingots are superposed and welded by roll-bonding and reduced in thickness.

It may prove suitable if the slabs or rolling ingots, after having been superposed, are secured against displacement relative to one another by stabilizing brackets.

The method according to the invention is of a particular relevance in terms of quality and costs, if continuously cast slabs are used. Thereby the field of application for continuously cast slabs has been considerably extended, as the ratio of the thickness of the prematerial, i.e., the slab thickness, to the plate thickness may be very small. Continuously cast slabs, if produced under appropriately selected conditions, have a perfect surface and internal structure. Moreover, they have only a small segregation zone of low intensity. Continuously cast slabs, therefore, are practically free of internal cracks and poor in inclusions so that they may be chosen as particularly advantageous for the method according to the invention.

For delicate steel qualities, the slabs or rolling ingots superposed into packs suitably are sealed by a welding frame, the pack sealed by a welding frame suitably being evacuated prior to roll-bonding.

DETAILED DESCRIPTION OF THE INVENTION

Figure 1:
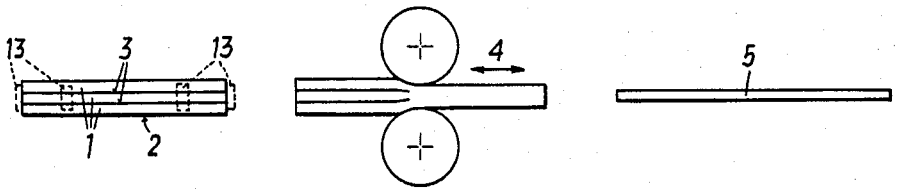
Figure 2:
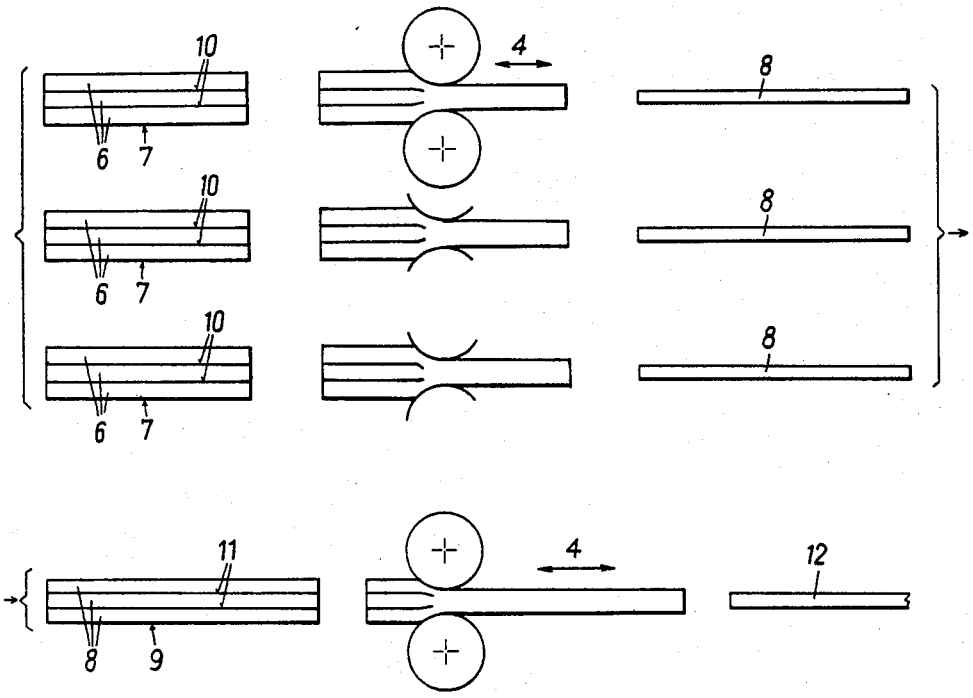

The method according to the invention will now be explained in more detail by way of the following examples schematically illustrated in FIGS. 1 and 2.

EXAMPLE 1 (FIG. 1)

A plate having a thickness of 150 mm is to be produced of unalloyed structural steel. For carrying out the method, continuously cast slabs 1 having a thickness of 200 mm are available. In order to achieve the mechanical properties required by the plate, a four-time deformation is considered sufficient. Accordingly, three continuously cast slabs 1 are superposed so as to form a pack 2, the pack 2 having a thickness of about 600 mm prior to its deformation. The slabs 1 are derived from one strand and from one melt. The slab surfaces 3 that come to lie one above the other are ground prior to the formation of the pack. If the ground slab surfaces are sufficiently plane, an evacuation of the pack-(after having welded the edges of the superposed slabs)-may be omitted.

After the formation of the pack, the pack is rolled down to a thickness of 150 mm by hot rolling in several passes (indicated by arrows 4). The prematerial, i.e., the continuously cast slabs 1, having a high degree of purity of non-metallic inclusions so that, after the hot rolling procedure, a homogenous material having a thickness of 150 mm is obtained. This is proved by ultrasonic testing. The plate 5 thus obtained is produceable at considerably lower costs than according to the conventional procedure via ingot casting.

EXAMPLE 2 (FIG. 2)

A plate having a thickness of 300 mm is to be produced. The continuous casting plant available enables the production of 300 mm thick slabs 6 to be used as prematerial for this plate. The ratio of the slab thickness to the thickness of the plate to be produced thus is one. In order to achieve a deformation as high as possible, it is determined to produce the plate of nine continuously cast slabs, in several steps. At first, three packs 7 are formed of three slabs each, each pack being welded into a rolling ingot 8 by roll-bonding. The roling ingots 8 thus formed have a thickness of 250 mm. These three prerolled rolling ingots 8 subsequently are assembled into a further pack 9 (rolling ingot pack) having a thickness of about 750 mm, which is finally rolled down to the desired end thickness of 300 mm by roll-bonding. When rolling, the usual hot rolling conditions are observed. All superposed surfaces 10, 11 of the slabs 6 as well as of the rolling ingots 8 were ground prior to the formation of the pack. The plate 12 produced according to this method also meets all the quality demands set.

According to the method of the invention, as many slabs are superposed as are necessary for reaching the pack thickness necessary for achieving the desired degree of deformation. When using continuously cast slabs, which are known to have very plane surfaces and thus bond excellently when rolled, special measures, such as edge welding and/or evacuating the pack, are not necessary in most cases; grinding the sides of the slabs that come into contact with each other and securing them against displacement by, e.g., stabilizing brackets 13 (illustrated in FIG. 1 in broken lines), will do. Basically, any technology applied when cladding by roll-bonding may, however, be followed. If the slabs have an abnormal surface profile, e.g., if they are heavily cambered, and a perfect welding is thus not guaranteed, it is suitable to predeform the individual slabs and only then superpose them into a pack.

In case the plate to be produced is to have a large thickness or if a great number of slabs is required for the desired deformation degree, it is advantageous to form "subpacks" and to deform each of these subpacks into a rolling ingot by roll-bonding and subsequently superpose the rolling ingots into a "rolling ingot pack" and weld them by roll-bonding, wherein it may be departed from any desired number of slabs and continued to work with any desired number of rolling ingot packs.

What we claim is:

1. A method of producing a plate of steel, in particular a plate having a thickness of more than 50 mm, by hot-rolling a prematerial in several passes, which method comprises the steps of superposing at least two slabs of equal steel quality constituting said prematerial so as to obtain a pack, securing said at least two slabs against displacement relative to one another by applying stabilizing brackets on said pack, and welding said at least two slabs by roll-bonding and reducing said pack in thickness.

2. A method as set forth in claim 1, wherein said at least two slabs are ground on their surfaces coming into contact with each other.

3. A method of producing a plate of steel, in particular a plate having a thickness of more than 50 millimeters, by hot-rolling a prematerial in several passes, which method comprises the steps of superposing at least two slabs of equal steel quality constituting said prematerial so as to obtain a pack, securing said at least two slabs against displacement relative to one another by at least two spaced stabilizing means, and welding said at least two slabs by roll-bonding and reducing said pack in thickness.

4. A method as set forth in claim 3, wherein said slabs are ground on surfaces coming into contact with each other.

5. A method as set forth in claim 1 or 3, wherein said at least two slabs are leveled by pre-deformation.

6. A method as set forth in claim 1 or 3, wherein said at least two slabs are derived from the same steel melt.

7. A method as set forth in claim 1 or 3, wherein said at least two slabs are continuously cast slabs.

8. A method of producing a plate of steel, in particular a plate having a thickness of more than 50 mm, by hot-rolling a prematerial in several passes, which method comprises the steps of forming at least two packs each comprised of at least two slabs constituting said prematerial, welding said at least two packs so as to obtain at least two rolling ingots, superposing said rolling ingots, securing said at least two rolling ingots against displacement relative to one another by applying stabilizing brackets on said rolling ingots, and welding said rolling ingots by roll-bonding and reducing them in thickness.

9. A method as set forth in claim 1 or 3, wherein the resultant plate of steel is of a thickness that is substantially equal to or thinner than one of the individual slabs.

* * * * *